United States Patent [19]

Carson

[11] 4,109,469

[45] Aug. 29, 1978

[54] POWER GENERATION FROM REFINERY WASTE HEAT STREAMS

[75] Inventor: Don B. Carson, Mt. Prospect, Ill.

[73] Assignee: UOP Inc., Des Plaines, Ill.

[21] Appl. No.: 770,178

[22] Filed: Feb. 18, 1977

[51] Int. Cl.[2] ..... F01K 13/00; F01K 25/08

[52] U.S. Cl. ..... 60/676; 60/651

[58] Field of Search ..... 60/641, 649, 651, 670, 60/650, 671, 676

[56] References Cited

U.S. PATENT DOCUMENTS

| | | | |
|---|---|---|---|
| 1,014,418 | 1/1912 | Shuman | 60/648 X |
| 3,292,366 | 12/1966 | Rice | 60/651 |
| 3,479,817 | 11/1969 | Minto | 60/671 |
| 4,033,141 | 7/1977 | Gustafsson | 60/671 |

*Primary Examiner*—Allen M. Ostrager

*Attorney, Agent, or Firm*—James R. Hoatson, Jr.; Robert W. Erickson; William H. Page, II

[57] ABSTRACT

The integration of a petroleum refinery, or a petrochemical complex, with an off-site power facility in which the latter provides a vaporizable coolant for vaporization in the former. Vaporization is effected through indirect contact with one or more waste heat streams; the resulting vapors are expanded through a turbine, to a lower pressure, from the resulting motion of which power is generated. In most instances, the process generates more power than its connected load. Preferably, the coolant is indirectly contacted, at elevated pressure, with a plurality of refinery process streams in series and in the order of increasing temperature. Resulting vaporized coolant phases are passed through individual turbines, or through different stages of a multiple-stage turbine.

9 Claims, 1 Drawing Figure

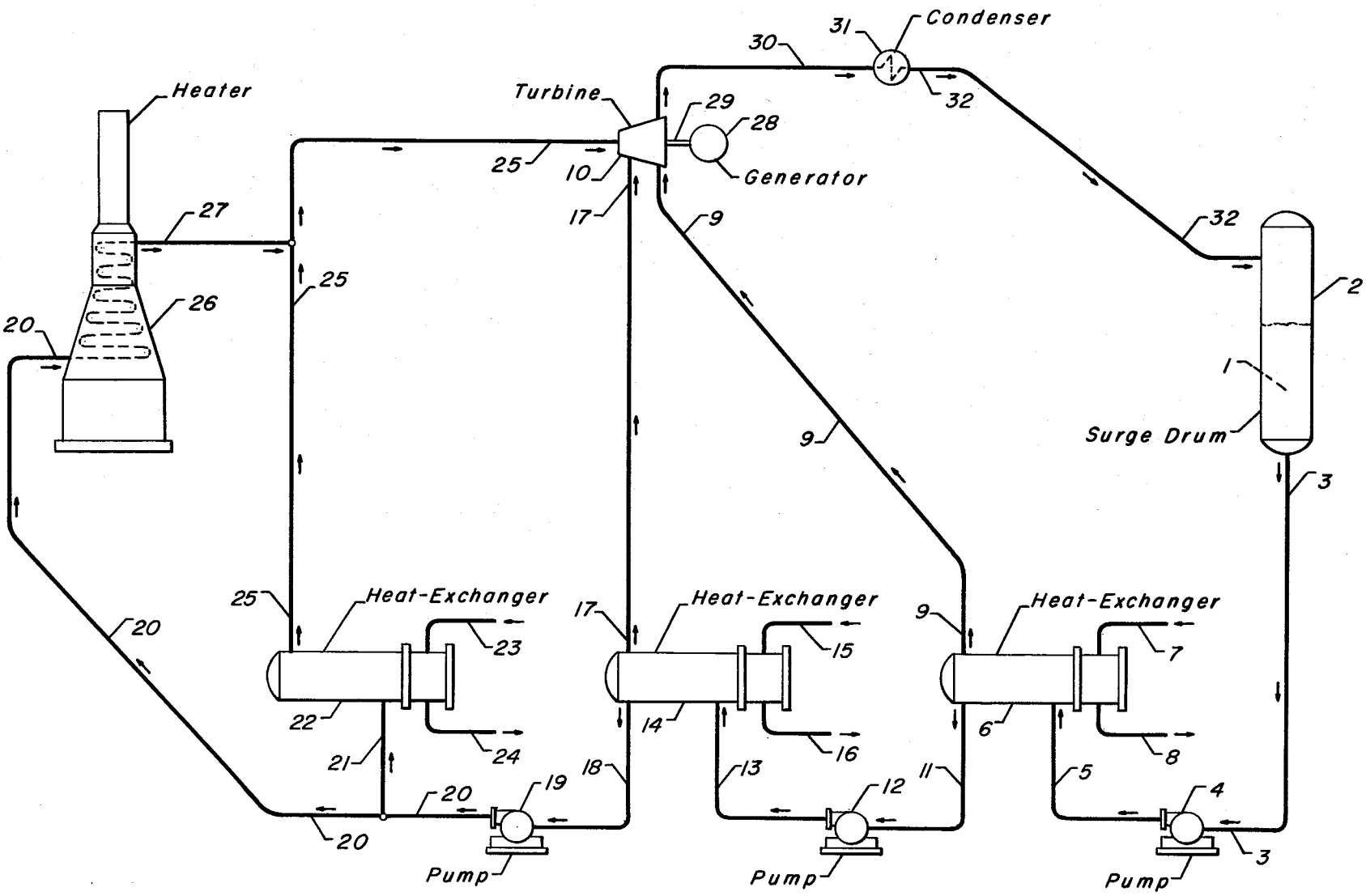
Surge Drum
Heat-Exchanger
Heat-Exchanger
Heat-Exchanger
Pump
Pump
Pump
Condenser
Generator
Turbine
Heater

POWER GENERATION FROM REFINERY WASTE HEAT STREAMS

APPLICABILITY OF INVENTION

Whether considering (1) the availability of natural gas, (2) the sufficiency of known oil reserves, or (3) heretofore untapped sources of coal, the consensus of many knowledgeable scientific experts indicates that a severe energy crisis is, or will soon become an established fact. One consequence is, of course, that a corresponding shortage of electrical power can be foreseen; that is, it is rapidly becoming impractical to convert one or more of these energy sources into electrical power. By way of attempting to alleviate this situation, serious consideration is currently being given to harnessing solar energy and utilizing naturally-occurring ocean thermal gradients. However, it would appear that very little effort is being expended in utilizing refinery waste heat, aside from the common practice of generating low-pressure steam in so-called waste heat boilers.

In petroleum refining processes and petrochemical complexes, both of which are intended to be encompassed by the use herein of the term "refining" process, an average of 4.0 to 8.0 percent of design throughput is used to satisfy process heat requirements. Considering a total refinery which has a design capacity of 200,000 Bbl/day of crude oil, this means that about 12,000 barrels will be consumed in providing the refinery's process heat requirements, much of which will be rejected as waste heat to flue gas, cooling water or air at temperatures which range from about 150° F. (65° C.) to about 450° F. (232° C.). The intent of the process encompassed by the inventive concept herein described is to utilize this waste heat to generate power.

Briefly, my invention involves indirectly contacting a vaporizable coolant, under elevated pressure, with one or more refinery process streams and expanding the resulting vapors through a turbine to a lower absolute pressure. Power is generated from the resulting motion of the turbine.

OBJECTS AND EMBODIMENTS

A principal object of the present invention resides in the utilization of refinery waste heat streams for power generation. A corollary objective is to decrease the quantity of other sources of energy used to supply the requirements of a petroleum refining process, or petrochemical complex.

A specific object involves the generation of electrical power from waste heat streams.

Therefore, in one embodiment, the present invention encompasses a process for the generation of power which comprises the steps of: (a) contacting a coolant at elevated pressure with at least one refinery process stream having a temperature sufficient to vaporize a portion of said coolant; (b) expanding the resulting coolant vapors through a turbine to a lower pressure; and, generating power from the resulting motion of said turbine.

This embodiment is further characterized into that an unvaporized portion of the coolant is passed into the convection section of a direct-fired heater, the resulting vapors from which are introduced into and through a turbine.

In a more specific embodiment, my invention is directed toward a process for the generation of power from refinery waste heat streams which comprises the sequential steps of: (a) indirectly contacting a coolant at elevated pressure with a plurality of refinery process streams in series, said process streams having elevated temperatures sufficient to vaporize at least a portion of said coolant; (b) expanding the resulting coolant vapors through a turbine to a lower pressure; (c) generating power from the resulting motion of said turbine; and, (d) (i) passing the unvaporized portion of said coolant through the convection section of a direct-fired heater, the temperature of which is sufficient to vaporize substantially all of the unvaporized portion, (ii) expanding the resulting coolant vapors through a turbine to a lower pressure and, (iii) generating additional power from the resulting motion of said turbine.

This specific embodiment is further characterized in that the coolant contacts the refinery process streams in the order of increasing temperature. Other objects and embodiments will become evident from the following detailed description of the power generation process encompassed by my inventive concept.

PRIOR ART

As hereinbefore stated, much consideration is being given to the utilization of ocean thermal gradients and the harnessing of the almost limitless supply of solar energy to generate power; this is borne out by a perusal of the available prior art. Including articles published in various trade and scientific journals, as well as issued patents, the trend seems to be concentrated in the use of various devices for providing a supply of solar heat and for the desalination of non-potable water. Exemplary of these are: U.S. Pat. Nos. 3,803,591 (Cl. 202–34), issued Aug. 20, 1957; 2,813,063 (Cl. 202–234), issued Nov. 12, 1957; and, 2,848,389 (Cl. 202–234), issued Aug. 19, 1958, all of which involve particular "solar stills".

An article entitled "Efforts to Tap Ocean Thermal Energy Gain," Chemical and Engineering News, Feb. 9, 1976, pp. 19–20, in part discusses the use of available ocean thermal gradients. In one particular system, a working fluid such as propane or ammonia is employed in a closed Rankine cycle. Warm surface water passes through a heat exchanger-evaporator, causing vaporization of the working fluid. The vapor then is expanded in a turbine to generate electric power. From the turbine, the vapor passes to a heat exchanger-condenser, where it is cooled and condensed by cold deep ocean water, and recycled to the heat exchanger-evaporator.

Thus, although recognizing that ammonia or a light hydrocarbon may be vaporized and passed through a turbine to a lower pressure, for the purpose of generating power, there appears to be no awareness of employing refinery waste heat streams and/or flue gases. In accordance with the present invention, these high temperature streams are used to supply vaporized coolant for introduction through the turbine, from the resulting motion of which power may be generated. As previously stated, this permits the complete integration of a petroleum refinery, or petrochemical complex with an off-site power generation facility. As will be recognized by those possessing the requisite skill in the art, in addition to the tremendous quantity of electrical power which is available, there results significant economic advantages for both the refinery and the off-site power generation facility.

SUMMARY OF INVENTION

Substantial quantities of electrical power can be generated from refinery waste heat streams; not only is such waste heat thus utilized, but there exists a corresponding decrease in the overall quantity of power necessarily obtained from an off-site facility. The normal complete refinery consumes from 4.0% to about 8.0% (by volume) of its crude run to provide its own internal heat requirements. A great bulk of this large heat demand is rejected to cooling water or air; moreover, the rejection is made at various temperature levels ranging from about 150° F. (65° C.) to about 450° F. (232° C.). The present invention encompasses a technique for generating significant quantities of power from these waste heat process streams. Thus, it is conceived that an off-site power generation facility would supply a vaporizable coolant to the refinery; waste heat vaporizes the coolant and the vapors may be returned to the power plant to generate power through a turbine. In an illustrative example which follows, a typical refinery will generate about 27,000 kw. of power which is in excess (about double) of its total connected load. To take the most advantage of all the available power, the local power generation facility and the refinery should be involved in an integrated capacity. Based upon oil firing, the waste heat available from the refinery used in the following illustration will generate power in an amount equivalent to that of a conventional power facility requiring $3,600,000 per operating year worth of fuel oil.

With respect to the off-site facility, additional power generation capacity is made available at no increased risk with respect to the environment. Furthermore, there exists a capital cost savings of about $≠200.00/kw-hr. through the elimination of the boiler and stack section of the conventional power generation system. This converts to an approximate capital cost savings of $5,400,000 in the presented illustration. Additionally, the value of the recovered waste heat, compared to oil firing at $11.00/Bbl., a fuel value of 1.52 cents per kilowatt-hour, is $410.00/hour; coal firing at a fuel cost of $20.00/ton, or 0.72 cents per kilowatt-hour, equates to $194.00/hour.

In accordance with the present power generation process, a vaporizable coolant is indirectly contacted, at elevated pressures, with one or more refinery process streams which generally are available at temperatures of from about 150° F. (65° C.) to about 450° F. (232° C.). Preferably, the coolant contacts a plurality of such process streams in series, and in the order of increasing temperature. That is, the unvaporized portion of the coolant passes in series through the plurality of heat-exchange vessels. The individual resulting vaporous phases are passed either through individual turbines, or into and through different stages or a multiple-stage turbine.

Suitable vaporizable coolants include anhydrous ammonia and the lower molecular weight hydrocarbons. Preferred classes of hydrocarbons are paraffins and mono-olefins containing from about one to about five carbon atoms per molecule, and include, therefore, methane, ethane, ethylene, propane, propylene, butane and butylene (including isomers), pentane, iso-pentane and neo-pentane, as well as mixtures thereof. Especially preferred are propane, propylene, butanes and/or butylenes and their isomers. Halogenated hydrocarbons, containing fluorine and/or chlorine, most of which are categorized under the generic name "Freon" (a trademark for a line of fluorinated hydrocarbons) may also be employed in the closed-loop system, or vaporization cycle. Exemplary of these halogenated hydrocarbons are trichloromonofluoromethane, dichlorodifluoromethane, monochlorotrifluoromethane, monobromotrifluoromethane, tetrafluoromethane, monochlorodifluoromethane, trichlorotrifluoroethane, dichlorotetrafluoroethane, octafluorocyclobutane, tetrachlorodifluoroethane, etc.

The precise number of refinery process streams employed in the plurality is not essential to the present invention. Any study for a proposed new design, or of a revamp of an existing unit, will consider the duty (BTU/hr.) and temperatures of all the cooler/condensers, as well as the flue gases emanating from the convection sections of the direct-fired heaters, to compute the total energy available. In actuality, the bulk of the recovered energy comes from a few of the sevices installed in the unit. As a general rule, 20.0% of the cooler/condensers will produce about 67.0% of the available energy. Obviously, careful consideration must be given to all economic aspects involved in balancing costs, value of generated power, and increasing capital costs per unit of incremental power.

In further describing my invention, reference will be made to the accompanying drawing which illustrates several embodiments thereof. These are presented by way of a simplified, schematic flow diagram in which details such as instrumentation and controls, valving, start-up lines and similar hardware have been eliminated on the grounds of not being essential to a concise presentation and clear understanding of the techniques which are involved. The utilization of these miscellaneous appurtenances, to modify the illustrated process, is well within the purview of one skilled in the appropriate art, and the use thereof will not create a departure from the scope and spirit of the appended claims.

DESCRIPTION OF DRAWING

With specific reference now to the drawing, the same will be described in conjunction with a 200,000 Bbl./day commercial refinery having a plurality of individual, but integrated petroleum refining processes. For the purposes of this illustrative example, the vaporizable coolant will be substantially pure iso-butane available at a temperature of about 93.3° F. (34° C.) and a pressure of about 67 psia. (4.56 atm.). The iso-butane 1 is withdrawn from a surge tank, or other storage vessel 2, through line 3 at the rate of about 21,500 gpm. (1,356 liters/sec.). A 1,500-HP pump 4 increases the pressure to about 145 psia. (9.87 atm.), and the coolant passes through line 5 into heat-exchanger 6. The heat-exchange medium is introduced by way of line 7, and exits via line 8 for introduction thereby into a cooler/-condenser (not illustrated). Iso-butane vapors, at a temperature of about 150° F. (65° C.) are introduced through conduit 9 into multiple-state turbine 10. Heat is recovered from the heat-exchange medium in the amount of about 316 MM BTU/hr. (79.6 kg-cal/hr.).

Unvaporized iso-butane is withdrawn from heat-exchanger 6 through line 11, in the amount of about 16,000 gpm. (1,009 liters/sec.), and is increased to about 227 psia. (15.45 atm.) by a 1,240-HP pump 12. The iso-butane stream passes through line 13 into heat-exchanger 14 wherein it contacts, indirectly, a second refinery process stream which enters via line 15 and exits via line 16. Heat is recovered, in the amount of about 280 MM BTU/hr., in a vaporized iso-butane stream withdrawn through conduit 17 and introduced thereby at a temperature of about 190° F. (88° C.) into a second stage of turbine 10. The remaining 10,300 gpm.

(650 liters/sec.) of unvaporized iso-butane passes through line 18 into an 840-HP pump 19 which discharges into line 20 at a pressure of about 317 psia. (21.57 atm.). About 6,700 gpm. (423 liters/sec.) are diverted through line 21 into heat-exchanger 22, wherein total vaporization is effected via indirect contact with a third refinery process stream introduced via line 23 and withdrawn via conduit 24. An additional 168 MM BTU/hr. of heat is recovered in the vaporous stream in line 25. The remaining 3,600 gpm. (227 liters/-sec.) continue through line 20 and are introduced thereby into convection section of heater 26. Total vaporization is effected and 91 MM BTU/hr. of heat is recovered. The iso-butane vapors are withdrawn through conduit 27, admixed with the vapors in line 25 and continue therethrough into a third stage of turbine 10 at a temperature of about 225° F. (107° C.). Although direct-fired heater 26 is illustrated as a single heater, it is intended to be inclusive of a multitude of heaters, or a heater bank.

The vapors are expanded to a pressure of about 72 psia. (4.90 atm.) in turbine 10, and the resulting motion, via shaft 29, generates 26,980 kw. of power in generator 28. The exiting turbine vapors pass through line 30 into and through cooler/condenser 31, and are introduced into surge drum 2 by way of conduit 32. Since the total pump "usage" consumes about 2,680 kw., the net power generation is about 24,300 kw.

The foregoing description of the process encompassed by the present invention, particularly when viewed in conjunction with the description of the accompanying drawing, is believed to present a clear understanding thereof as well as the advantage afforded through its utilization.

I claim as my invention:

1. A process for the generation of power which comprises the steps of:

(a) contacting a coolant at elevated pressure with at least one refinery process stream having a temperature sufficient to vaporize a portion of said coolant and separating resultant coolant vapors from unvaporized coolant;

(b) expanding the coolant vapors through a turbine to a lower pressure;

(c) passing said unvaporized coolant into the convection section of a direct-fired heater and therein vaporizing the same;

(d) introducing resultant vapors from said heater into said turbine; and (e) generating power from the resulting motion of said turbine.

2. The process of claim 1 further characterized in that said coolant is normally gaseous.

3. The process of claim 1 further characterized in that the exiting turbine vapors are condensed and recontacted with said refinery process stream.

4. The process of claim 2 further characterized in that said coolant is a normally gaseous hydrocarbon.

5. The process of claim 4 further characterized in that said hydrocarbon is halogenated.

6. A process for the generation of power from refinery waste heat streams which comprises the sequential steps of:

(a) indirectly contacting a coolant at elevated pressure with a plurality of refinery process streams in series, said process streams having elevated temperatures sufficient to vaporize at least a portion of said coolant, and separating resulting coolant vapors from unvaporized coolant;

(b) expanding the resulting coolant vapors through a turbine to a lower pressure;

(c) generating power from the resulting motion of said turbine; and, (d) (i) passing said unvaporized coolant through the convection section of a direct-fired heater, the temperature of which is sufficient to vaporize substantially all of the unvaporized coolant, (ii) expanding the resulting coolant vapors through a turbine to a lower pressure and, (iii) generating additional power from the resulting motion of said turbine.

7. The process of claim 6 further characterized in that said coolant is ammonia.

8. The process of claim 6 further characterized in that said coolant comprises a normally gaseous hydrocarbon having two to about four carbon atoms per molecule.

9. The process of claim 6 further characterized in that said coolant comprises a halogenated hydrocarbon.

* * * * *